US005194008A

United States Patent [19]

Mohan et al.

[11] Patent Number: 5,194,008

[45] Date of Patent: Mar. 16, 1993

[54] SUBLIMINAL IMAGE MODULATION PROJECTION AND DETECTION SYSTEM AND METHOD

[75] Inventors: William L. Mohan; Samuel P. Willits, both of Barrington; Steven V. Pawlowski, Hanover Park, all of Ill.

[73] Assignee: Spartanics, Ltd., Rolling Meadows, Ill.

[21] Appl. No.: 858,196

[22] Filed: Mar. 26, 1992

[51] Int. Cl.[5] ..... F41G 3/76

[52] U.S. Cl. ..... 434/22; 434/20; 273/316; 358/93

[58] Field of Search ..... 434/16, 17, 19, 20–23, 434/27; 358/93, 142, 146; 273/310–316, 358; 353/10, 30, 42; 250/493.1, 495.1

[56] References Cited

U.S. PATENT DOCUMENTS

| | | | |
|---|---|---|---|
| 4,065,860 | 1/1978 | Linton et al. | 434/22 |
| 4,079,525 | 3/1978 | Linton et al. | 434/18 |
| 4,177,580 | 12/1979 | Marshall et al. | 434/22 |
| 4,210,329 | 7/1980 | Steiger et al. | 273/312 X |
| 4,290,757 | 9/1981 | Marshall et al. | 434/20 X |
| 4,336,018 | 6/1982 | Marshall et al. | 434/22 |
| 4,553,943 | 11/1985 | Ahola et al. | 434/22 |
| 4,583,950 | 4/1986 | Schroeder | 434/22 |
| 4,608,601 | 8/1986 | Shreck et al. | 358/146 |
| 4,619,616 | 10/1986 | Clarke | 434/22 |
| 4,640,514 | 2/1987 | Myllyla et al. | 273/310 |
| 4,804,325 | 2/1989 | Willits et al. | 434/22 |
| 4,824,374 | 4/1989 | Hendry et al. | 434/22 |

*Primary Examiner*—Richard J. Apley
*Assistant Examiner*—Joe H. Cheng
*Attorney, Agent, or Firm*—Robert A. Brown

[57] ABSTRACT

Weapon training simulation system including a computer operated video display scene whereon is projected a plurality of visual targets. The computer controls the display scene and the targets, whether stationary or moving, and processes data of a point of aim sensor apparatus associated with a weapon operated by a trainee. The sensor apparatus is sensitive to non-visible or subliminal modulated areas having a controlled contrast of brightness between the target scene and the targets. The sensor apparatus locates a specific subliminal modulated area and the computer determines the location of a target image on the display scene with respect to the sensor apparatus.

36 Claims, 12 Drawing Sheets

MONOCHROME GREEN

SUBLIMINAL IMAGE MODULATION PROJECTION AND DETECTION SYSTEM AND METHOD

BACKGROUND OF THE INVENTION

This disclosure relates generally to a weapon training simulation system and more particularly to means providing the trainee with a (multi-layered) multi-target video display scene whose scenes have embedded therein trainee invisible target data.

Weapon training devices for small arms employing various types of target scene displays and weapon simulations accompanied by means for scoring target hits and displaying the results of various ones of the trainee actions that result in inaccurate shooting are well known in the arts. Some of these systems are interactive in that trainee success or failure in accomplishing specific training goals yields different feedback to the trainee and possibly different sequences of training exercises. In accomplishing simulations in the past, various means for simulating the target scene and the feedback necessarily associated with these scenes, have been employed.

Wilits, et al, in U.S. Pat. No. 4,804,325 employs a fixed target scene with moving simulated targets employing point sources on the individual targets. Similar arrangements are employed in the U.S. Pat. No. 4,177,580 of Marshall, et al, and U.S. Pat. No. 4,553,943 of Ahola, et al. By contrast, the target trainers of Hendry, et al in U.S. Pat. No. 4,824,374; Marshall, et al in U.S. Pat. Nos. 4,336,018 and 4,290,757; and Schroeder in U.S. Pat. No. 4,583,950 all use video target displays, the first three of which are projection displays. In the Hendry device, a separate projector projects the target image and an invisible infra-red an hot spot located on the target which is detected by a weapon mounted sensor. Both Marshall patents employ a similar principal and Schroeder employs a "light pen" mounted o the training weapon coupled to a computer for determining weapon orientation with respect to a video display at the time of weapon firing.

Each of these devices of the prior art, while useful, suffers from either or both of realism deficiencies or an inability to operate over the wide range of target-background contrast ratios encountered in real life while simultaneously providing high contrast signals to their aim sensors, and efforts to overcome these deficiencies have largely failed.

SUMMARY OF THE INVENTION

It is a principal object of the invention to provide a trainee with a target display that appears to the trainee as being readily and continuously adjustable in visually perceived brightness and contrast ratio of target brightness to scene background/foreground brightness, i.e., from a very low contrast ratio to a very high contrast ratio.

Yet a further principal object of the invention is to provide a trainee with a target display that is either monochromatic, bi-chromatic, or having full chromatic capabilities, that appear to the trainee as being readily and continuously adjustable in visually perceived hue, brightness and contrast of target scene to background-/foreground scene.

It is a further object of the invention to simultaneously provide to the systems aim sensors a target display area that appears to the sensor as being modulated at an optimal and constant contrast ratio of target brightness to background brightness to thereby make the operation of the system's sensor totally independent of the brightness and contrast ratio perceived by a human trainee viewing the display.

Another object of the invention is to utilize an aim sensor which comprises a novel "light pen" type pixel sensor which when utilized in conjunction with the inventive target display, has the capability of sensing any point in a displayed scene containing targets which, when perceived by the trainee, is either very dark or very bright in relation to the background or foreground brightness of the scene.

Yet another object of the invention is to provide in a weapon training simulator system a novel "light pen" type pixel sensor combined with a target display which provides a specific high contrast area modulated at a specific frequency associated with each visual target to ensure a high signal-to-noise ratio sensor output independent of the visually perceived, variable ratio image selected for the trainee display.

Still further, a primary object of the invention is to provide a weapons training simulator whose novel, point-of-aim sensor means is capable of spectral-selective discrimination of said target area, wherein said target area scene, a specific area is chromatically modulated at a specific frequency, to ensure a high signal-to-noise ratio of sensor's output, independent of the visually perceived colored image selected for the trainee.

The foregoing and other objects of the invention are achieved in the inventive system by utilizing a computer controlled video display comprising a mixture of discrete and separate scenes utilizing, either alone or in some combination, live video imagery, pre-recorded real-life imagery and computer generated graphic imagery presenting either two dimensional or realistic three dimensional images in either monochrome or full color. These discrete scenes when mixed comprise both the background and foreground overall target scenes as well as the images of the individual targets the trainee is to hit, all blended in a controlled manner to present to the trainee overall scene and target image brightnesses such as would occur in real life in various environments and times of day. Simultaneously, the target scene and aim sensor are provided with subliminally displayed information which results in a sensor perceived high and constant ratio of target brightness to background and foreground brightness independent of the trainee perceived and displayed target scene brightness and contrast. The objects of the invention are further achieved by providing a simulator system for training weapon operators in use of their weapons without the need for actual firing of the weapons comprising background display means for generating upon a target screen a stored visual image target scene, generating means for showing upon said visual image target scene one or more visual targets, either stationary or moving, with controllable visual contrast between said one or more visual targets and said visual image target scene, said generating means further comprising means for displaying one or more non-visible modulated areas, one for each of said one or more visual targets, sensor means aimable at said target scene and at said one or more targets and sensitive to said one or more non-visible modulated areas and operable to generate output signals indicative of the location of one of said one or more non-visible modulated areas with respect to said sensor means, computing means connected to said background display means to control said visual image target scene and said one or more targets generated thereon so as to provide said controllable contrast therebetween, and said computing means connected to said sensor means effective to utilize said sensor means output signals to compute the location of the image of said one of said one or more targets with respect to said sensor means. The nature of the invention and its several features and objects will be more readily apparent from the following description of preferred embodiments taken in conjunction with the accompanying drawings.

DESCRIPTION OF THE PREFERRED EMBODIMENTS

Figure 1:
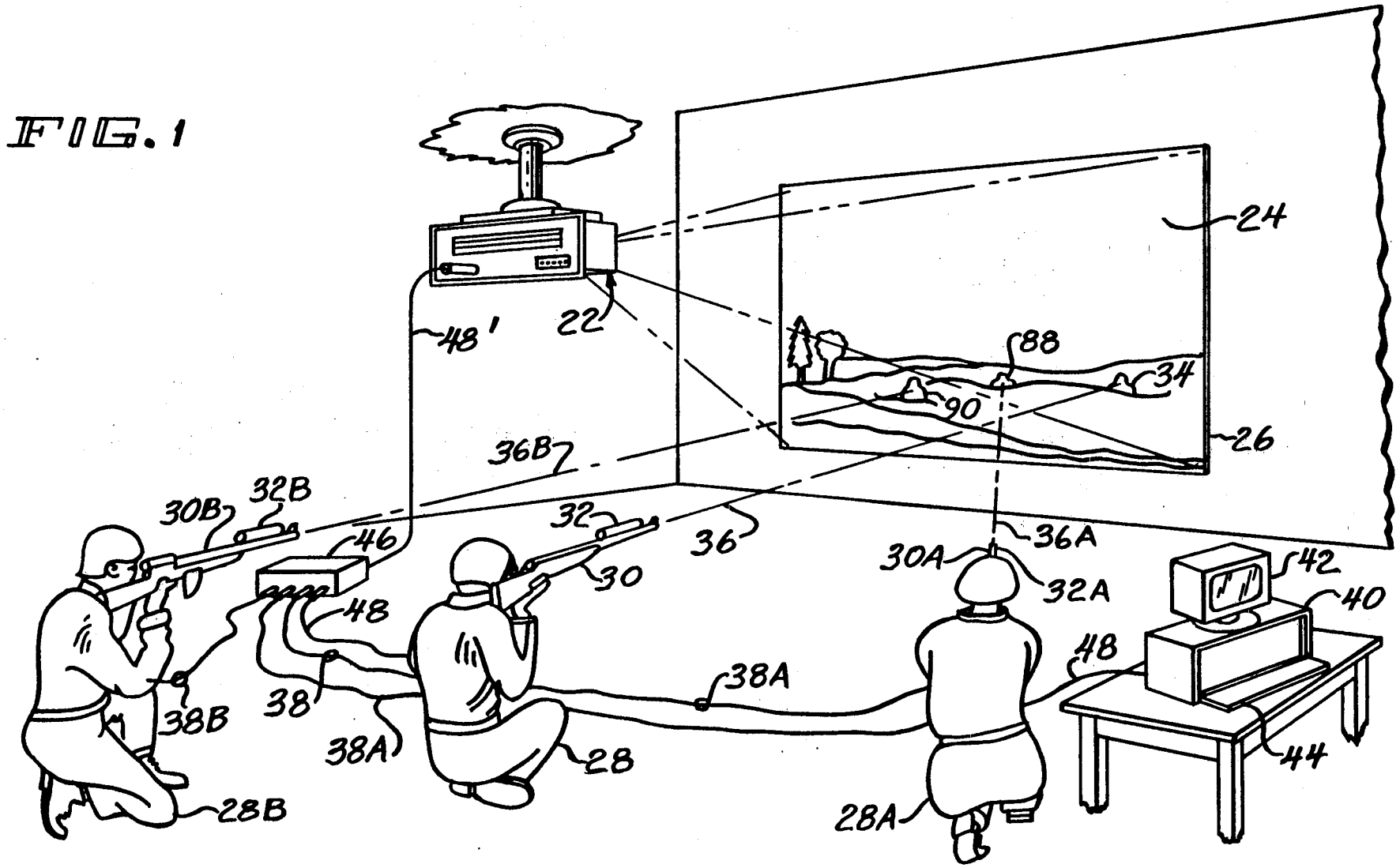
FIG. 1 is a perspective view of the image projection and detection system of the invention.

The general method involved in generating a video target scene whose brightness and contrast ratio have apparently different values as observed by a human viewer and as concurrently sensed by an electro-optical sensor means, can best be understood if one understands the video standards employed.

Standard U.S. TV broadcast display monitors update a 512 line video image scene every 1/30 of a second using a technique called interlacing. Interlacing gives the impression to the viewer that a new image frame is presented every 1/60 of a second which is a rate above that at which flicker is sensed by the human viewer. In reality, each picture frame is constructed of two interlaced odd and even field images. The odd field contains the 256 "odd" horizontal lines of the frame, i.e., lines 1-3-5 . . . 255; and the even field contains the 256 "even" numbered lines of the frame, i.e., lines 2-4-6 . . . 256.

The entire 256 lines of the odd field image are first rastered out or line sequentially written on the CRT in 1/60 of a second. Then the entire 256 lines of the even field image are then sequentially written in 1/60 of a second with each of its lines interlaced between those of the previously written odd field. Thus, each 1/30 of a second a complete 512 line image frame is written. The viewer then sees a flicker-free image which is perceived as being updated at a rate of sixty times per second.

The complete specifications governing this display method are found in specification EIA-RS-170 as produced by the Electronic Industry Association in 1950. It is a feature of the invention that utilizing this known display technique in a novel manner allows the simultaneous presentation of images to a human observer that are of either high or low contrast including target contrast to the scene field while simultaneously presenting high contrast target locating fields to the weapon trainer aim sensor.

One method employed in the practice of the invention and in the target display's simplest form utilizes monochromatic viewing. Utilizing the previously discussed 512 line interlaced mode of generating a video image for projected viewing or for video monitor viewing, a video image is generated that is composed of alternate lines of black and of white, i.e., all "odd" field lines are black and all "even" field lines are white. The image if viewed on either a 512 horizontal line monitor or as a screen projected image, both having the proper 512 horizontal line interlace capabilities, will look to the human observer under close inspection, as a grid of alternate black and white lines spatially separated by 1/512 of the vertical viewing area. If this grid image, or a suitable portion thereof, is displayed and imaged upon a properly defined electro-optical sensing device having specific temporal and spectral band pass characteristics, the output voltage of the sensor would assume some level of magnitude relative to its field of view and the average brightness of that field having essentially no time variant component related to the field of view or its position on that displayed field.

If, however, instead of feeding this 512 line computer generated interlaced grid pattern to a 512 line compatible display means, it was fed into a video monitor or projection system that has only 256 active horizontal lines capability per this 256 line system would sequentially treat (or display image) each field; first the all black odd line field and then the al white even line field with each field now being a complete and discrete projected frame. In other words, the 256 horizontal line system would first sequentially write from top-down the "odd" field of all 256 dark lines in 1/60 of a second as a distinct frame. At the end of that frame it would again start at the top and sequentially write over the prior image the "even" field, thus changing the black lines to all white. Thus, the total image would be cyclically changing from all black to all white each 1/30 of a second. If this image is viewed by a human observer, it appears as a gray field area having a brightness in between the white and black alternating fields.

If, however, this alternating black and white 256 line display is imaged and sensed by a properly defined electro-optical sensing device having the specific electrical temporal band pass capabilities whose total area of sensing is well defined and relatively small in area as compared to the total projected display area, but whose area is large as compared to a single line-pixel area, the sensing device would generate a periodic alternating waveform whose predominate frequency component would be one half the frequency rate of the displayed field rate. For this discussion, since a display field rate of 60 frames per second is employed, a thirty cycle per second data rate will be generated from the electro-optical sensor output means. The magnitude of this sensor's output waveform would be relative to the difference in brightness between the brightness of the "dark" field and the "white" field. The output waveform would have a spatially dependent, specific, phase relationship to the temporal rate of the displayed image and to the relative spatial position of the sensor's point-of-aim on the projected display area.

It is an invention feature that utilizing this interlacing technique at projected frame rates above the human observer, detectable flicker rate permits subliminal target identification and thus defines specific areas of a composite, large screen projected image or direct viewing device, that have very specific areas of interest, i.e., one or more "targets" for a trainee to aim at, wherein there is a subliminal uniquely modulated image area associated with each specific target image, cyclically varying in brightness or spectral content at a temporal rate above the visual detection capabilities of a human observer, but specifically defined spatially spectrally, and temporally, to be effective with a suitably matched electro-optical sensor, to generate a point-of-aim output signalor signals; while these same areas as observed by a human viewer would have the normal appearance of being part of the background, foreground or target imagery.

The previously referenced industry specification, EIA-RS-170, is but one of several common commercial video standards which exhibit a range of spatial and temporal resolutions due to the variations in the number of horizontal lines per image frame and the number of frames per second which are presented to the viewer. The inventive target display system may incorporate any of the standard line and frame rates as well as such non-standard line and frame rates as specific overall system requirements dictate. Thus the inventive target display system presents a controllable variable, contrast image scene to the human observer while concurrently presenting, invisible to humans, an optimized contrast and optimized brightness image scene modulation to a point-of-aim sensing device, thereby enabling the point-of-aim computer to calculate a highly accurate point-of-aim.

While this inventive system embodiment utilizes the interlace format to generate two separate frames from a single, high density interlace image frame system that then presents the odd and even frames to a non-interlaced capable viewing device having one half of the horizontal lines capabilities that system is just one of several means of generating specific spectral, temporal, and spatially coded images, not discernible to a human vision system but readily discernible to a specific electro-optical sensing device utilized in a multi-layered multi-color or monochromatic image projecting and detecting system.

The application of the inventive target display system is not limited to commercial video line and frame rates or to commercial methods of image construction from "odd" and "even" fields. Nor is the application of the inventive target display and detecting system limited to black and white, or any two color, video or projection systems. A full color R.G.B. system is equally as efficient in developing composite-layered images wherein specific discrete areas will appear to a human observer as a constant hue and contrast, while concurrently and subliminally, these discrete areas will present to a specific point-of-aim electro-optical sensing device, an area that is uniquely modulated at a rate above human vision sensing capabilities.

Another preferred embodiment of the invention achieves the desired effect of having a controllable and variable contrast ratio of target image scene as perceived by the human observer while concurrently presenting subliminally an optimized brightness contrast modulated target scene or an optimized brightness spectral modulation target scene to a point-of-aim sensing device. A composite complete video image scene, comprising foreground, background, and multiple target areas is designated as an image frame. It is composed of sequentially presenting a sequence of two or more subscene scene fields, in a non-interlaced manner. Each image scene frame consists of at least two image scene fields, with each field having 512 horizontal lines comprising the individual field image. The fields are presented at a rate of 100 fields per second. For this example, each complete image frame, comprising two sequentially projected fields is representative of a completed image scene. This completed image field is then accomplished in 1/50 of a second by rastering out the two aforementioned component scene fields in 450 of a second. The only difference in video content of these two subfields will be the specific discrete changes in color or brightness around the special target areas.

The presentation of these image frames is controlled by a high speed, real-time image manipulation computer. The component video scene fields are presented at a 100 fields per second, a visual flicker free rate to the observer and are sequenced in a controlled manner by the image manipulation computer through the allocation of specific temporal defined areas to the multiple, interdependent scene fields to generate the final layered composite image scene that has various spatially dispersed target images of apparent constant contrast, color and hue to a trainee's vision. In reality each completed scene frame will have multiple modulated areas one each associated with each of the various visual targets. Such modulated areas are readily detected by the specific electro-optical sensing device for determining the trainee's point-of-aim.

The individual scenes used to compose the final composite image may include a foreground scene, a background scene, a trainee's observable target scene, a point-of-aim target optical sensor's scene and data display scene. The source of these scenes may be a live pre-recorded video image, or a computer generated image. These images may be digitized and held in a video scene memory storage buffer so that they may be modified by the image manipulation computer.

Figure 5:
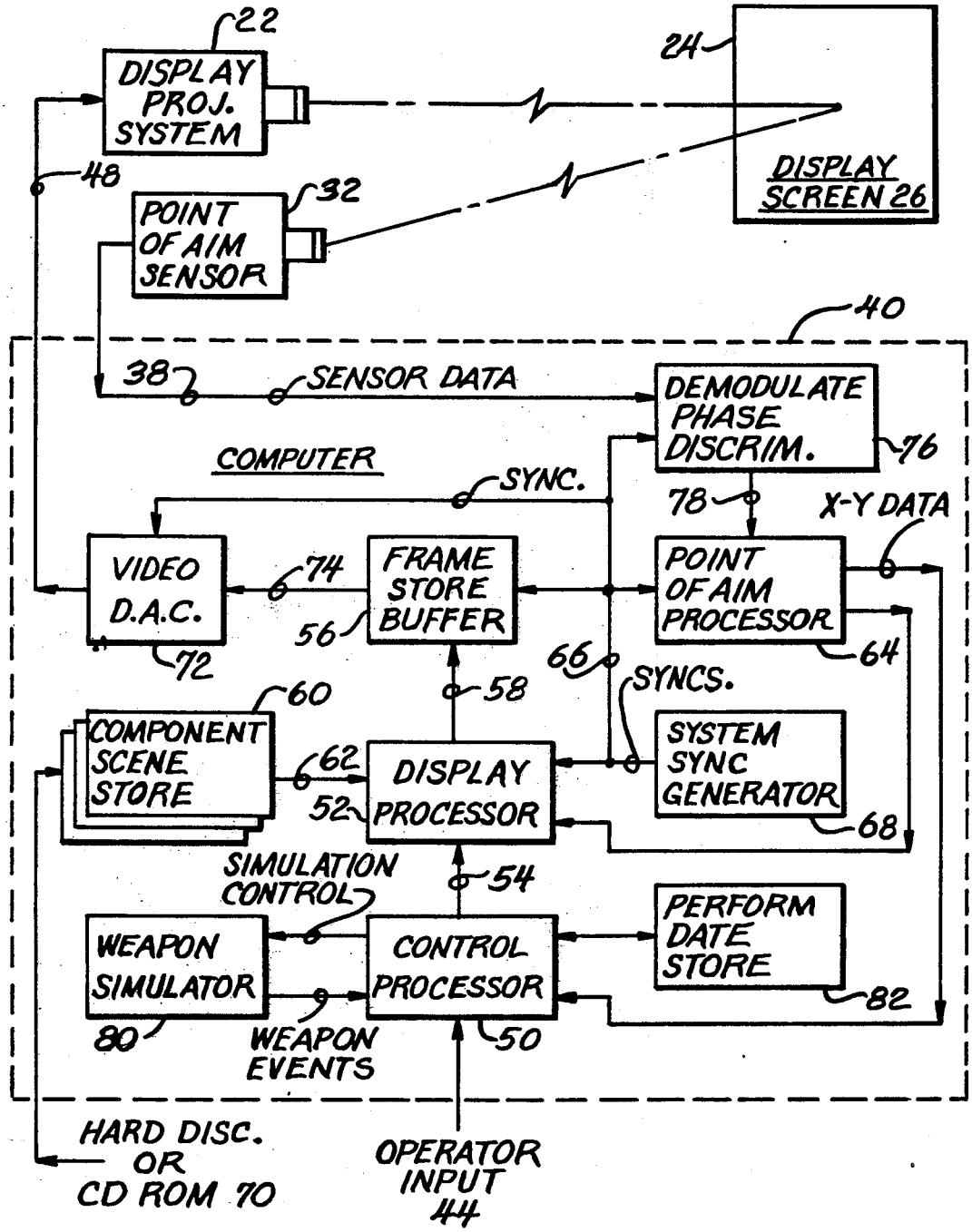
FIG. 5 is a schematic in block diagram form showing the preferred embodiment of the invention.

FIG. 1 is a pictorial embodiment of a preferred embodiment of the inventive system while FIG. 5 is a schematic of the system in block diagram form which illustrates the common elements of the several preferred embodiments of the invention. As will become apparent from the description which follows, the various inventive embodiments differ primarily in the manner of modulating the target image.

In FIG. 1, a ceiling mounted target scene display projector 22 projects a target scene 24 upon screen 26. A trainee 28 operating a weapon 30 upon which is mounted a point of aim sensor 32 aims the weapon at target 34 which is an element of the target scene 24. The line of sight of the weapon is identified as 36. An electrical cable 38 connects the output of weapon sensor 32 through system junction 46 to computer 40 having a video output monitor 42 and an input keyboard 44. Power is supplied to the computer and target scene display projector from a power source not shown. Cables 48 and 48' connect the control signal outputs of computer 40 to the input of target scene display projector 22 via junction 46. Computer 40 controls the display of the target scene 24 with target 34 and also controls data processing of the aim detection system sensors. Although not shown here for the purpose of simplifying the drawing and description of the present invention, it is to be understood that computer 40 may incorporate the necessary elements to provide training as set forth in the aforesaid Willits et al patent.

As shown in FIG. 1, the inventive system can provide for plural trainees. Any reasonable number within the capability of computer 40 may be simultaneously trained. The additional trainees are identified in FIG. 1 with the same reference numerals but with the addition of alpha numeric for the additional trainees. Further, while weapon 30 is illustratively a rifle, it should be understood that any hand held manually aimable or automatic optical tracking weapon could be substituted for the rifle without departing from the scope of the invention or degrading the training provided by the inventive system.

Certain elements of computer 40 pertinent to the practice of the invention are shown in FIG. 5. A control processor 50, which may have a computer keyboard input 44 (schematically shown) provides for an operator interface to the system and controls the sequence of events in any given training schedule implemented on the system. The control processor, whether under direct operator control, programmed sequence control, or adaptive performance based control, provides a sequence of display select commands to the display processor 52 via bus 54. These display select commands ultimately control the content and sequence of images presented to the trainee by the target scene display projector 22.

The display processor 52 under command of the control processor 50 loads the frame store buffer 56 to which it is connected by bus 5 with the appropriate digital image data assembled from the component scene storage buffers 60 to which it is connected by bus 62. This assembled visual image data is controllable not only in content but also in both image brightness and contrast ratio. It is a special feature of the invention that the display processor 52 also incorporates appropriate "sensor optimized" frames or sub-frames in the sequence of non-visual modulated sensor images to be displayed. Display processor 52 also produces a "sensor gate" signal to synchronize the operation of the point-of-aim processor 64 to which it is connected by bus 66. Sensor optimized frames and their advantageous use in low-contrast target scenes are described further herein below. Video sync signals provided by bus 66 from the system sync generator 68 are used to synchronize access to the frame store buffer 56 so that no image noise is generated during updates to that buffer.

The component scene storage buffers 60 contain a number of pre-recorded and digitized video image data held in full frame storage buffers for real time access and manipulation by the display processor 52. These buffers are loaded "off line" from some high density storage medium, typically a hard disk drive, VCR or a CD-ROM, schematically shown as 70.

The frame store buffer 56 holds the digitized video image data immediately available to write to and update the display. The frame store buffer is loaded by the display processor 52 with an appropriate composite image and is read out in sequence under control of the sync signals generated by the system sync generator 68.

Such composite image, designated as a "frame" is comprised of sub-frames designated as a "field". Such fields, separately, contain the same overall full picture scene with foreground-background imagery essentially identical to one another. The variation of imagery in sequentially presented fields that comprise a complete image "frame" is confined just to the special target area associated with each visual target in the overall scene. These special target areas are so constructed as to appear to the sensor means as to sequentially vary in brightness from sequential field to field or to vary in "color" content from field to field. Further, such variation in brightness or in hue or both of special target area will be indiscernible to the human observer. The system sync generator 68 produces timing and synchronization pulses appropriate for the specific video dot, line, field, and frame rate employed by the display system.

The output of the frame store buffer 56 is directed to the video DAC 72 by bus 74 for conversion into analog video signals appropriate to drive the target scene display projector 22. The video sync signals on bus 66 are used by the video DAC 72 for the generation of any required blanking intervals and for the incorporation of composite sync signals when composite sync is required by the display projector 22.

The target scene display projector 22 is a video display device which translates either the digital or the analog video signal received on bus 48 from video DAC 72 into the viewable images 24 and 34 required for both the trainee 28 and the weapon point of aim sensor 32. Video display projector 22 may be of any suitable type or alternately, may provide for direct viewing. The display system projector 22 may provide for either front or rear projection or direct viewing.

The point of aim sensor 32 is a single or multiple element sensor whose output is first demodulated into its component aspects of amplitude and phase by demodulator 76. Its output is directed via bus 78 to the point of aim processor 64. The output of the point of aim sensor is a function of the number of sensor elements, the field of view of each element, and the percentage of brightness or spectral modulation of the displayed image within the field of view of each element of the optical sensor.

The point of aim processor 64 receives both the point of aim sensor demodulation signals from demodulator 76 and the sensor gate signal from the display processor 52 and computes the X and Y coordinates of the point on the display at which the sensor is directed. Depending on the sensor type employed and the mode of system operation, the point of aim processor 64 may additionally compute the cant angle of the sensor, and the weapon to which it is mounted, relative to the display.

The X, Y and cant data is directed to the control processor 50 where it is stored, along with data from the weapon simulator store 80 for analysis and feedback.

The control processor 50 directly communicates with the weapon simulator store 80 to provide for weapons effects including but not limited to recoil, rounds counting and weapon charging. The weapon simulator system 80 relays information to the control processor 50 including but not limited to trigger pressure, hammer fall and mechanical position of weapon controls This data is stored along with weapon aim data from the point of aim processor 64 in the performance data storage buffer 82 where it is available for analysis, feedback displays, and interactive control of the sequence of events in the training schedule.

In the prior discussion, the inventive method of utilizing an interlace image created on a computer graphic system having twice the number of horizontal line capability as the video projector system was described. FIG. 1 shows the system's computer 40, the display projector 22 and the total scene image 24, which is projected as dictated by the computer 40.

Figure 2:
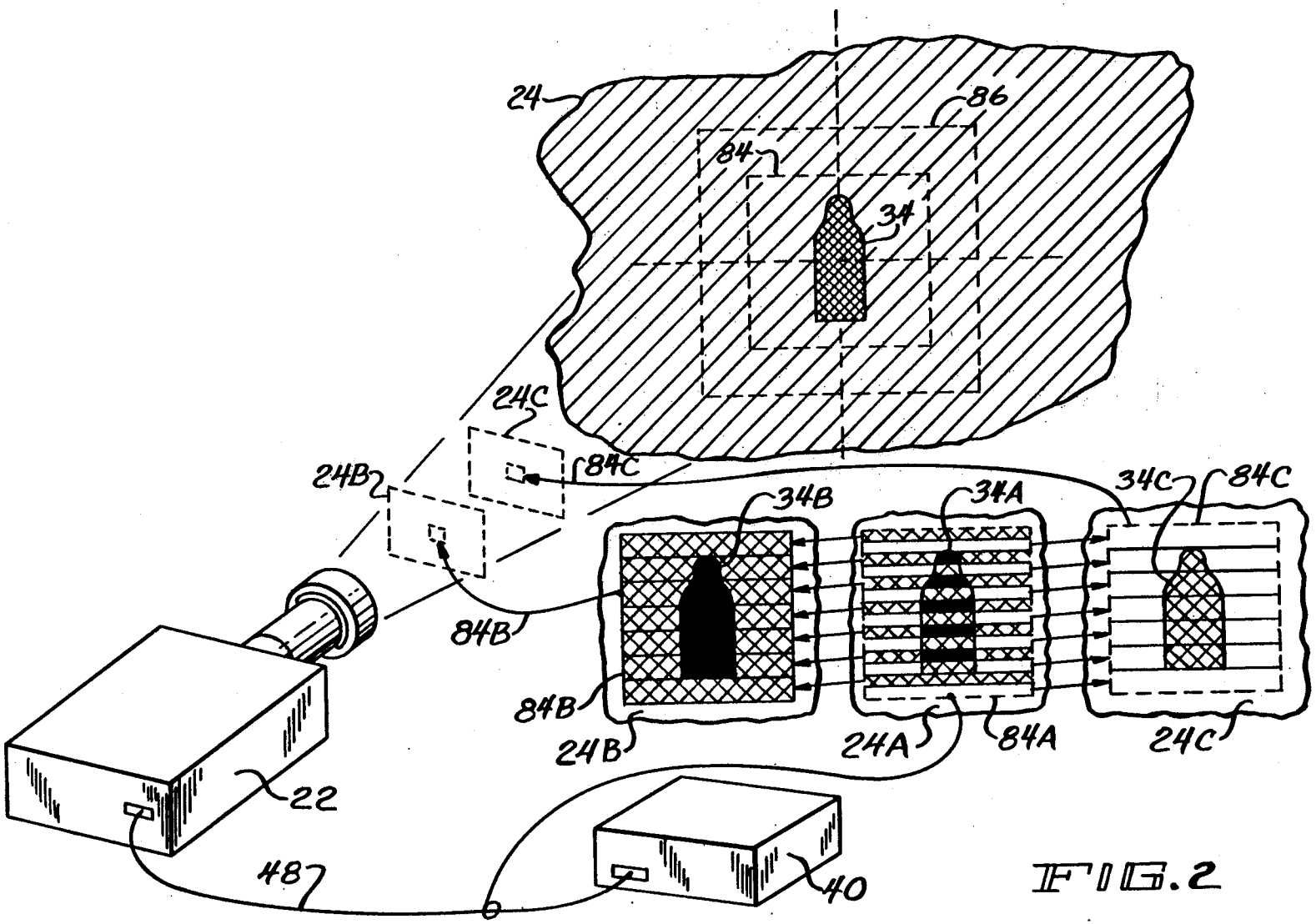
FIG. 2 is a pictorial representation of the "interlace" method of generating scene area modulation prior to the "layering" by the projection means.

FIG. 2 shows in detail the interlace method of generating target scene modulation. In FIG. 2 just those specific areas are shown which are associated with a specific target, where the odd field lines are different than their corresponding even field lines. In FIG. 2 the total image 24A is shown as composed in computer 40 to have twice the number of horizontal lines as projector 22 has a capability of projecting. In this total non-interlaced image 24A, there is situated one of the target images 34A and a uniquely associated area 84A. From a close visual inspection of this area 84A, it can be seen that the odd lines are darker than the even lines.

The computer image data 84A is sent to the projector 22, in the interlace mode, by rastering out in sequence via interconnect cables 48, first all the odd lines 1-3-5 . . . 255, to form field image 24B, containing unique associated area 84B and target image 34B, and then the even lines, 2-4-6 . . . 256, to form even field image 34C, containing unique associated area 84C and target image 34C. In all other areas of the total image scene not containing targets, the odd field is identical to the even field and will be indistinguishable by either the point of aim sensor 32 or the trainee.

Figure 3:
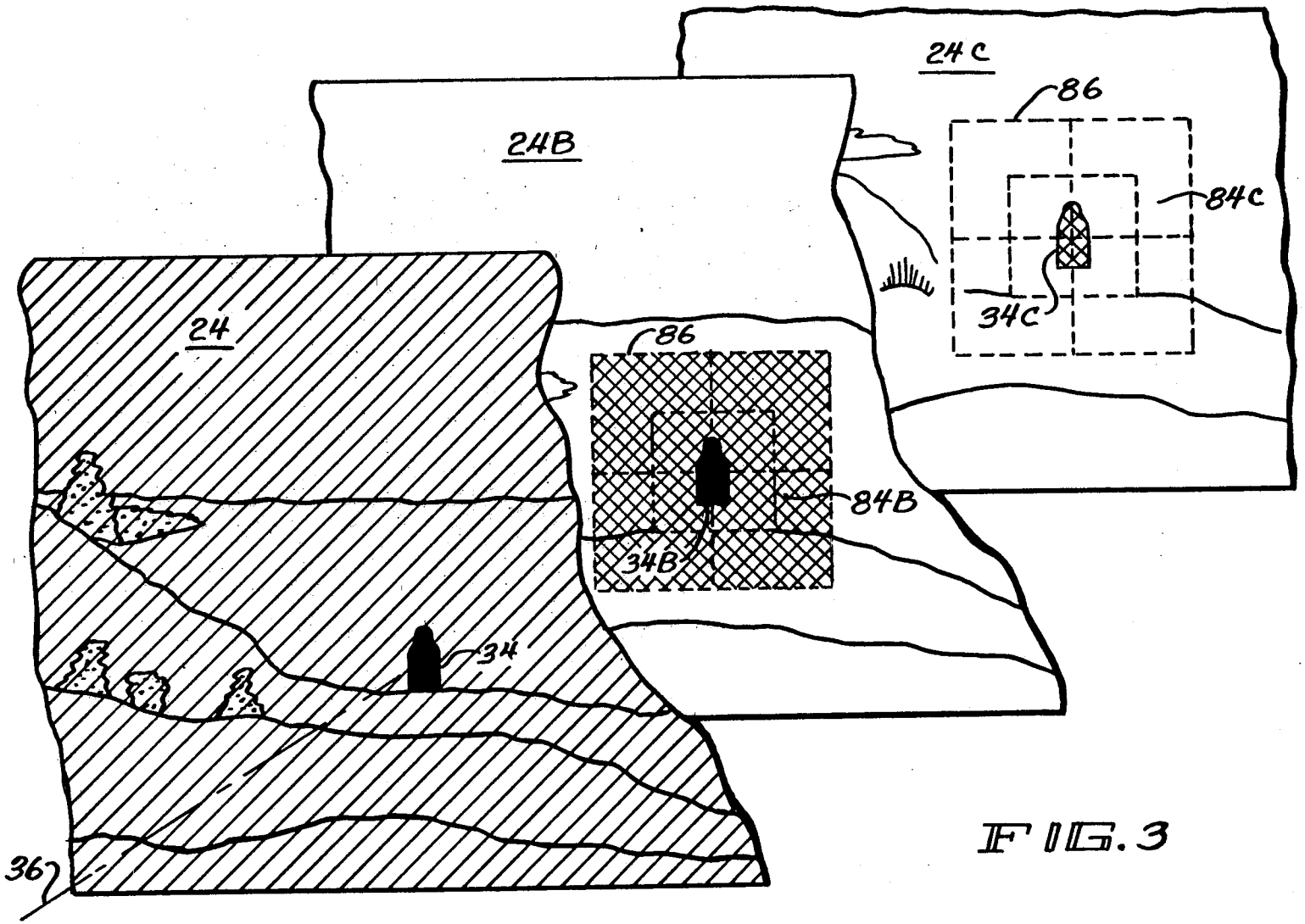
FIG. 3 is a pictorial time sequenced view of two independent scene "fields" that comprise the visual scene frame as viewed by an observer and as alternately viewed and individually sensed by the sensor of the invention.

FIG. 3 shows the sequentially projected odd field 24B and the even field image 24C. The trainee perceives these images that are sequentially projected at a rate of sixty image frames per second as a composite image 24 containing a target image 34. The trainee's line-of-sight to the target is shown as dotted line 36. The weapon sensor means 32 of FIG. 1 with its corresponding point of aim 36 comprises a quad-sensor whose corresponding projected field of view is shown as dashed-line 86 in odd field image 24B and in even field image 24C. The sensor's field of view 86 is shown ideally centered on its perceived alternating dark and light modulating brightness field areas 84B and 84C comprising the unique target associated area maintained for the purpose of enhancing sensor output signals under all contrast conditions.

Since the electrical response time of the sensor 32 is much faster than the rate of change of brightness between the alternating two target areas 84A and 84B, each of the sensors comprising the quad sensor array will generate a cyclical output voltage whose amplitude is indicative of the area of the sensor covered by the unique area of changing brightness and whose cyclic frequency is ½ of the frequency of the frame rate, e.g., 60 frames per second display generates sensor output data of 30 cycles per second. Further, the phase of the cyclical data generated by the individual sensors comprising sensor 32 are related to the absolute time interval of the start of each image frame being presented; the discussion relating to FIG. 6 will describe this relationship.

The previous description related to the generation of specific brightness modulated areas for optical aim sensing inside of a large scene area was for black and white images, and shades of gray. That method utilized a commercially available graphic computer system, capable of generating the desired interlace images, and then rastering out the odd field images and even field images at the system rate of sixty frames per second, into a suitable viewing device or projection device such that this image frame rate produced a brightness modulated rate of thirty cycles per second for the specific target areas of interest.

Figure 4:
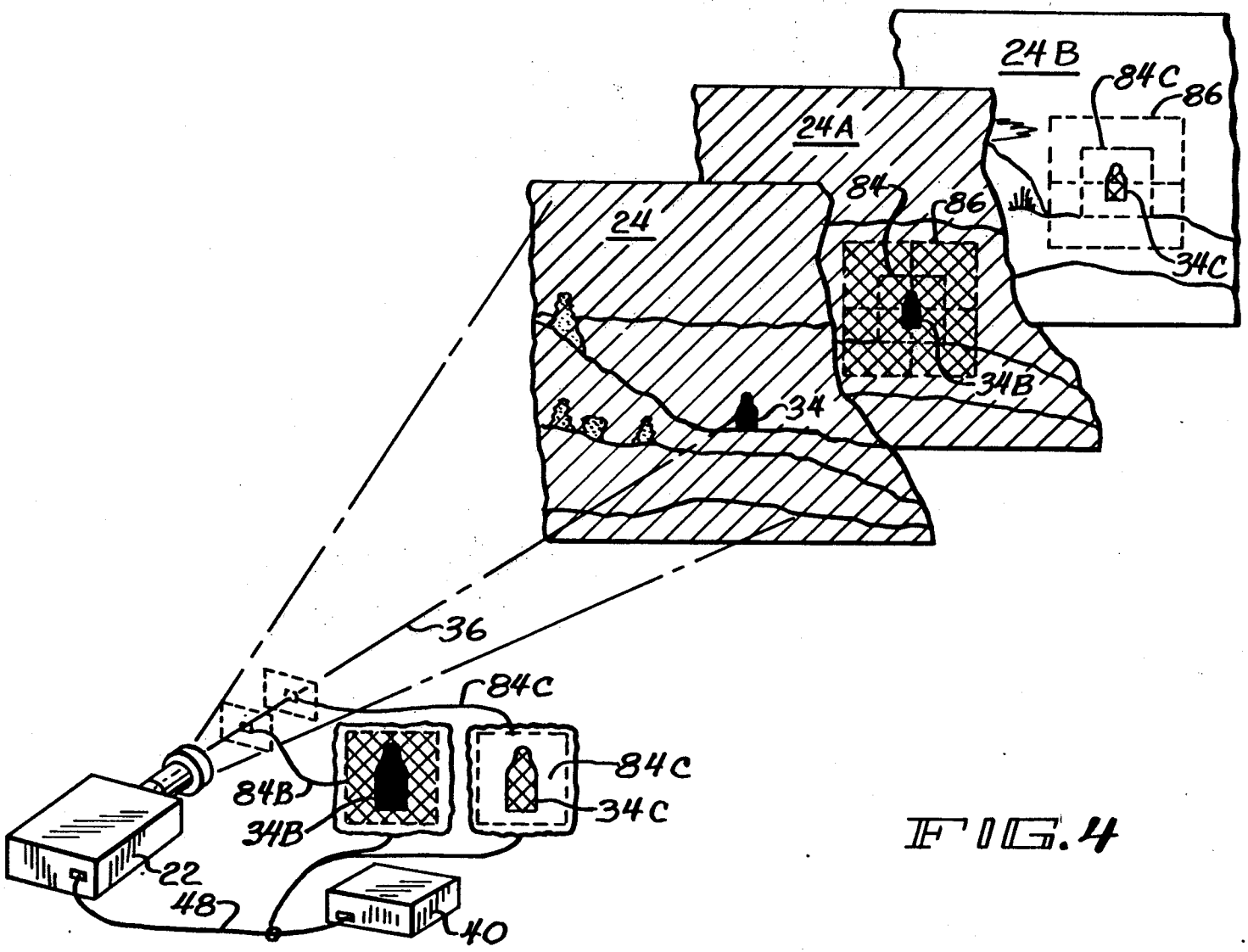
FIG. 4 thru FIG. 4E are pictorial representations of a non-interlaced, but layered method of generating scene area modulation.

FIG. 4 illustrates another preferred embodiment of the invention which produces projected images that are similar to those previously described, but developed in a different manner. Further, they can also be in black and white or all colors and shades of color whether in an RGB video projection system.

The system of FIG. 4 when employed with the circuitry of FIG. 5, creates a complete image scene frame by layering two or more separate scene fields, instead of delacing the interlace single image scene frame in the manner previously described. Each of these scene fields, independently, has the same number of vertical and horizontal lines as the projector means. Each of these scene fields, whether two or more fields are required to complete a final image scene are line sequentially rastered out at a high rate to the display projector to create the final composite target scene 24.

If three fields, layered, were required to complete the human observed target scene frame, the display system would have a cyclic frame rate of 1-2-3 . . . field scene; 1-2-3. . . Thus the modulated rate would be the frame rate divided by the number of image scenes fields required for the complete composite visual scene. Thus, for a composite scene comprising the layering of these individual scene fields, the individual scene modulation rate would be ⅓ the composite field rate. The total composite image scene, as observed by a human observer, appears as a normal multi-target scene of various size silhouettes blended into normal background foreground scenery. When the optical axis of the aim sensor 32 is directed at a particular target area. it detects a subliminal brightness or spectral modulated area associated with each individual target image silhouette, thereby generating cyclical electrical output data uniquely indicative of the sensor means' point-of-aim relative to the brightness or spectrally modulated special target area at which it is pointed.

The specific physical-optical size of this brightness modulated special target area as related to a quad-sensor electro-optical sensing means as shown is idealized and is explained in Willits, et al, U.S. Pat. No. 4,804,325 in conjunction with FIG. 9 of that patent. In that patent's discussion, the idealized illumination area is described as a "uniform-diffused source of illumination", which is not readily achievable. In this embodiment of the invention, the brightness or spectrally modulated special target area 84, FIG. 4 is specifically generated to match the desired physical area parameters as described in Willits, et al. Further, it is modulated in such a manner as to give it the distinct advantage of providing a highly selectable high signal-to-noise ratio, point-of-aim source of modulated energy for the point-of-aim sensor to operate with. Such area modulation can also be used to provide additional data relevant to the particular special target area the sensor detects by virtue of that area's cyclic phases; temporal and spatial, relationship to the total image frame cyclic rate of presentation.

The unique brightness modulated area associated with each specific target image silhouette has been generally described as "brightness modulated". Specifically, this unique area can be electro-optically constructed, having any percentage of brightness modulation required to satisfy both the sensor's requirements of detectability and the subliminal human visual image requirement of non-detectable changes in image scene brightness, hue, or contrast, as it pertains to a specific point-of-aim, special target area of interest, over the specific period of time of target image engagement.

Figure 4A:
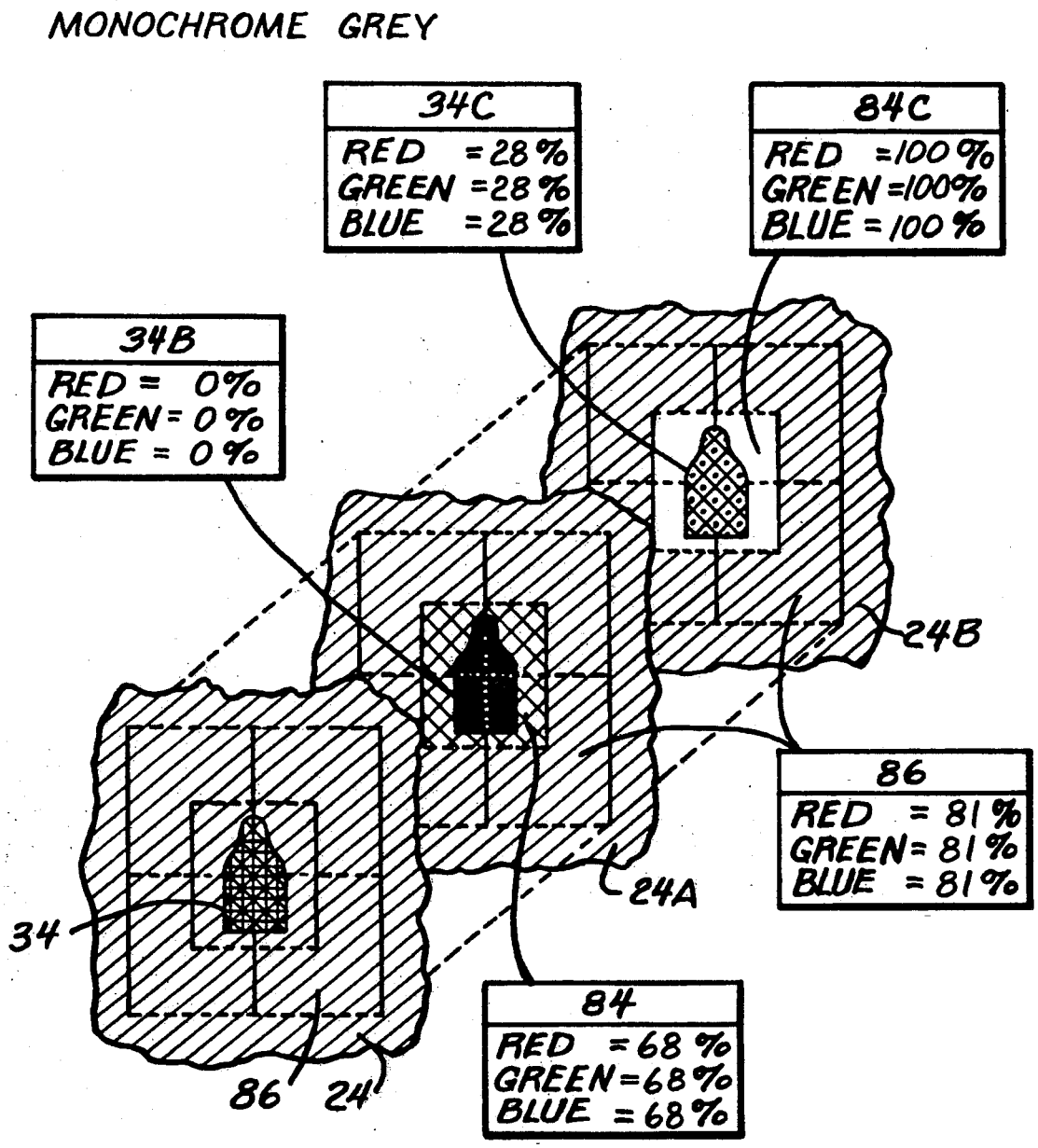
Figure 4B:
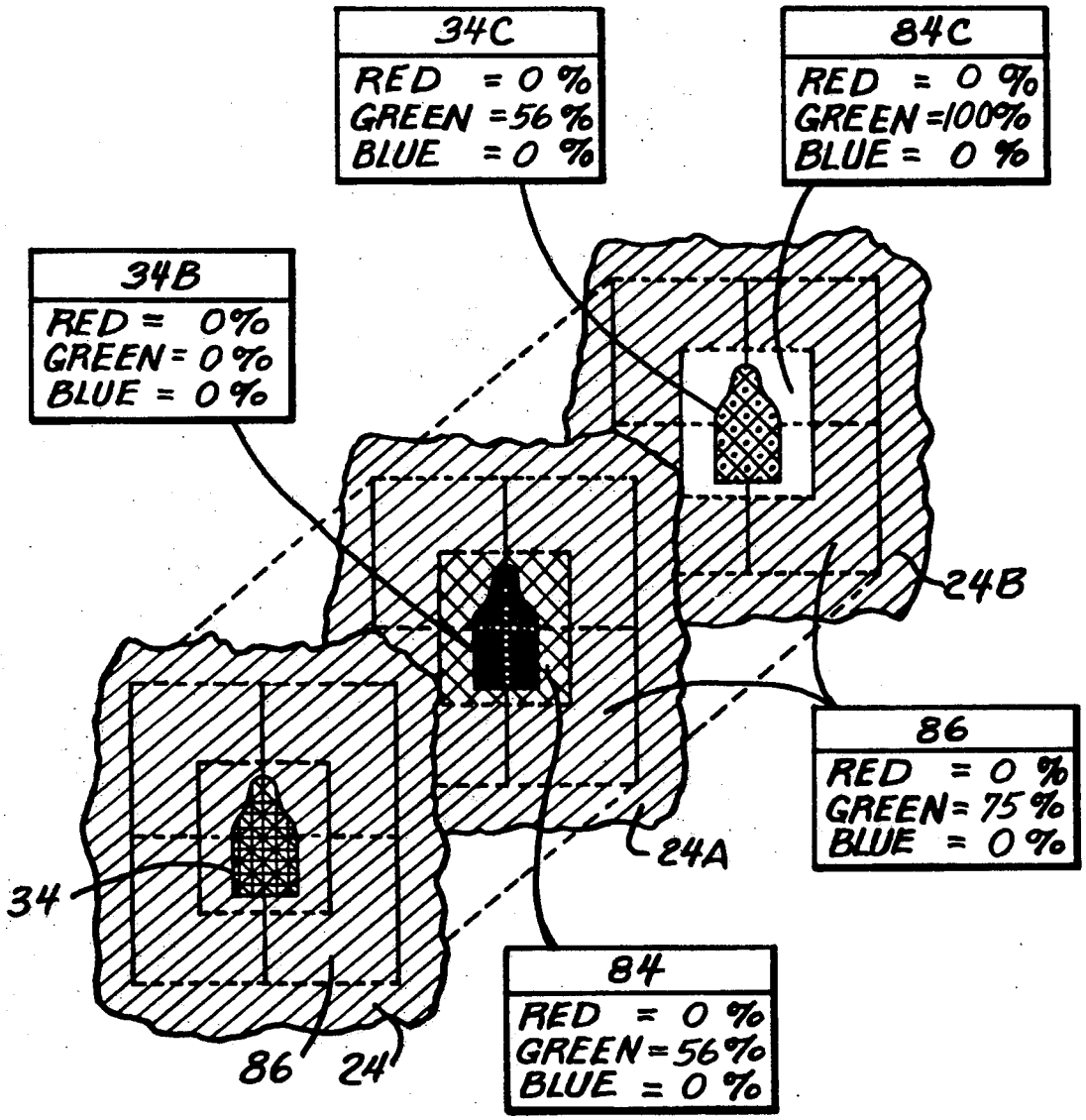
Figure 4C:
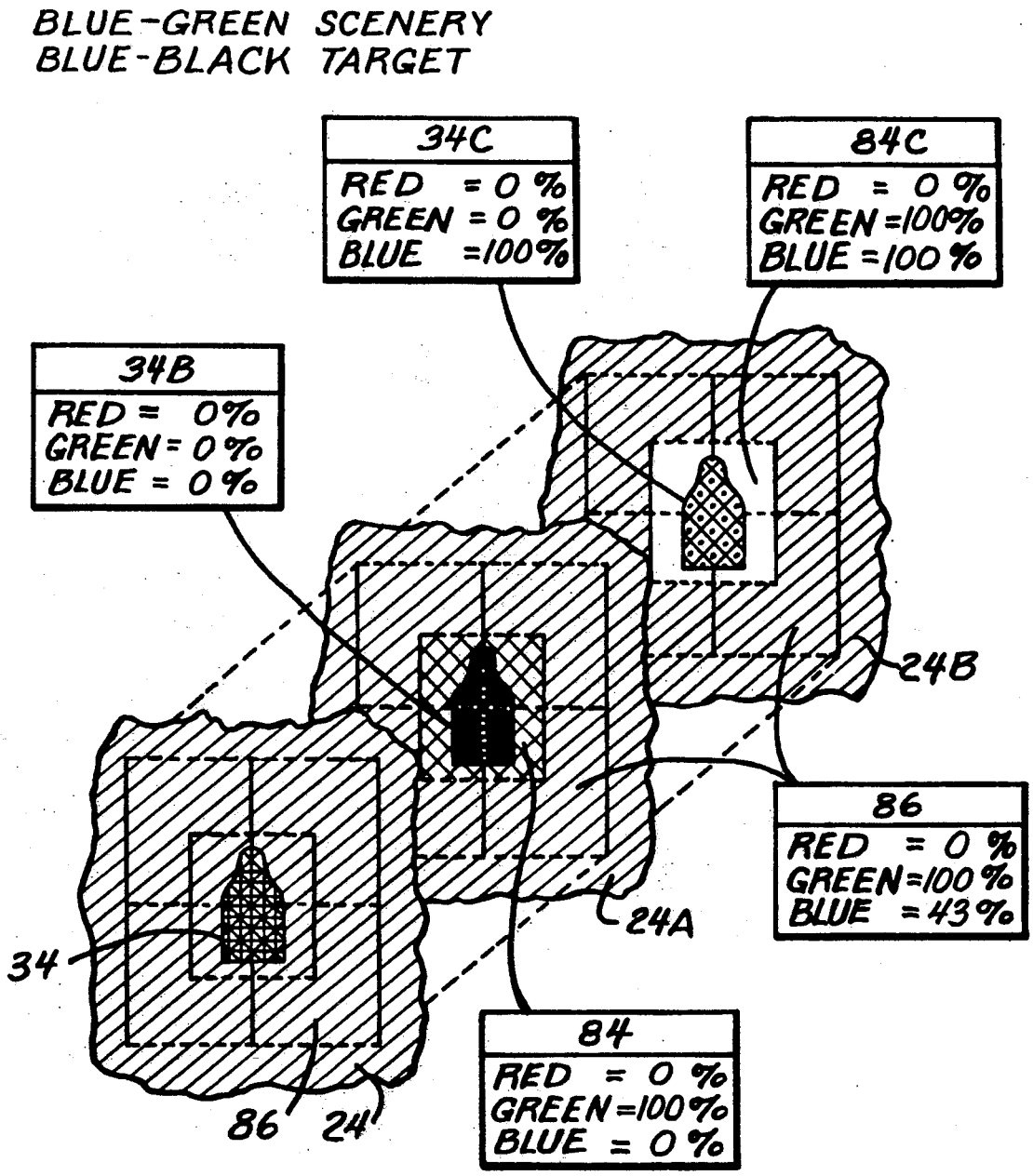
Figure 4D:
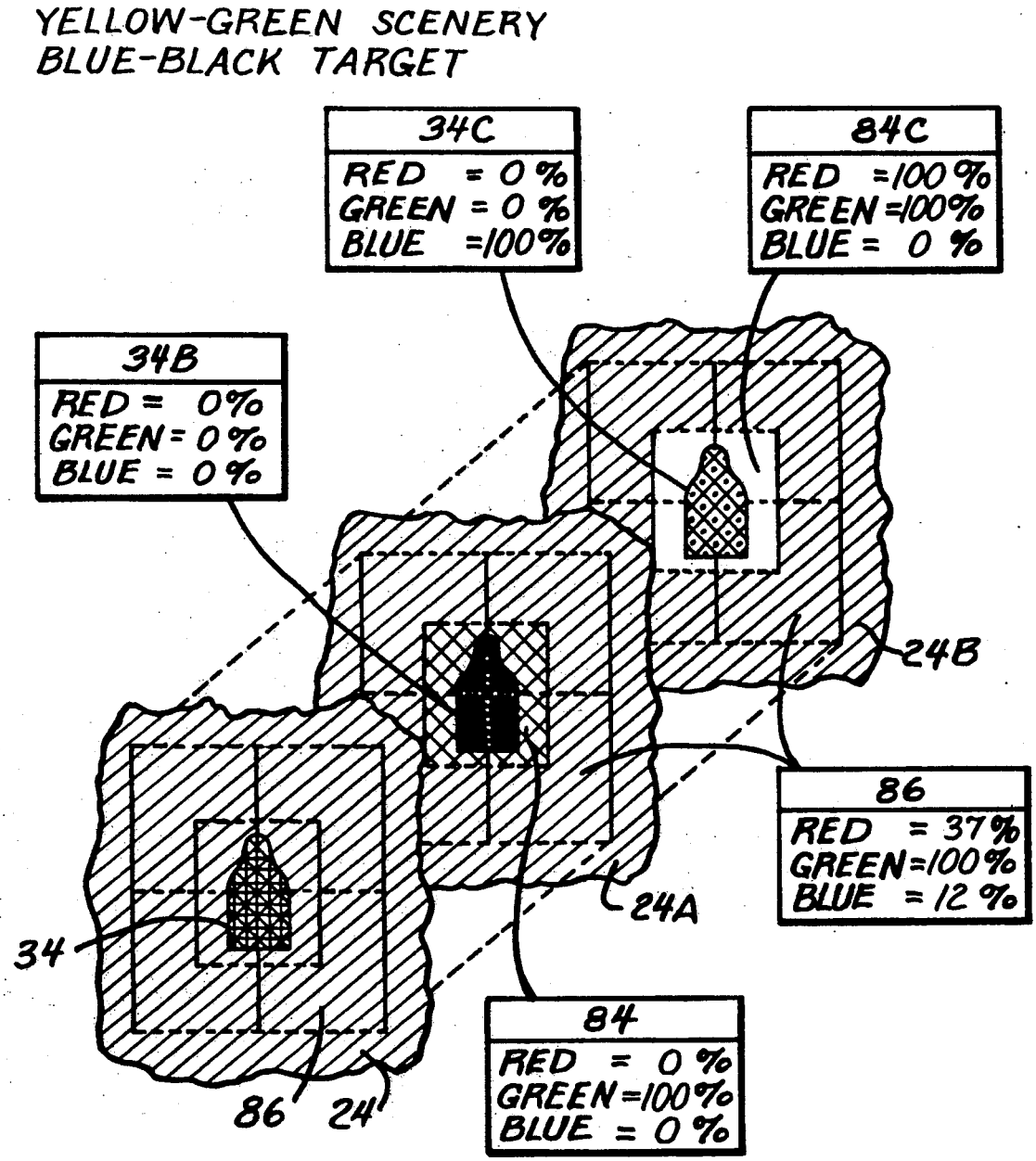
Figure 4E:
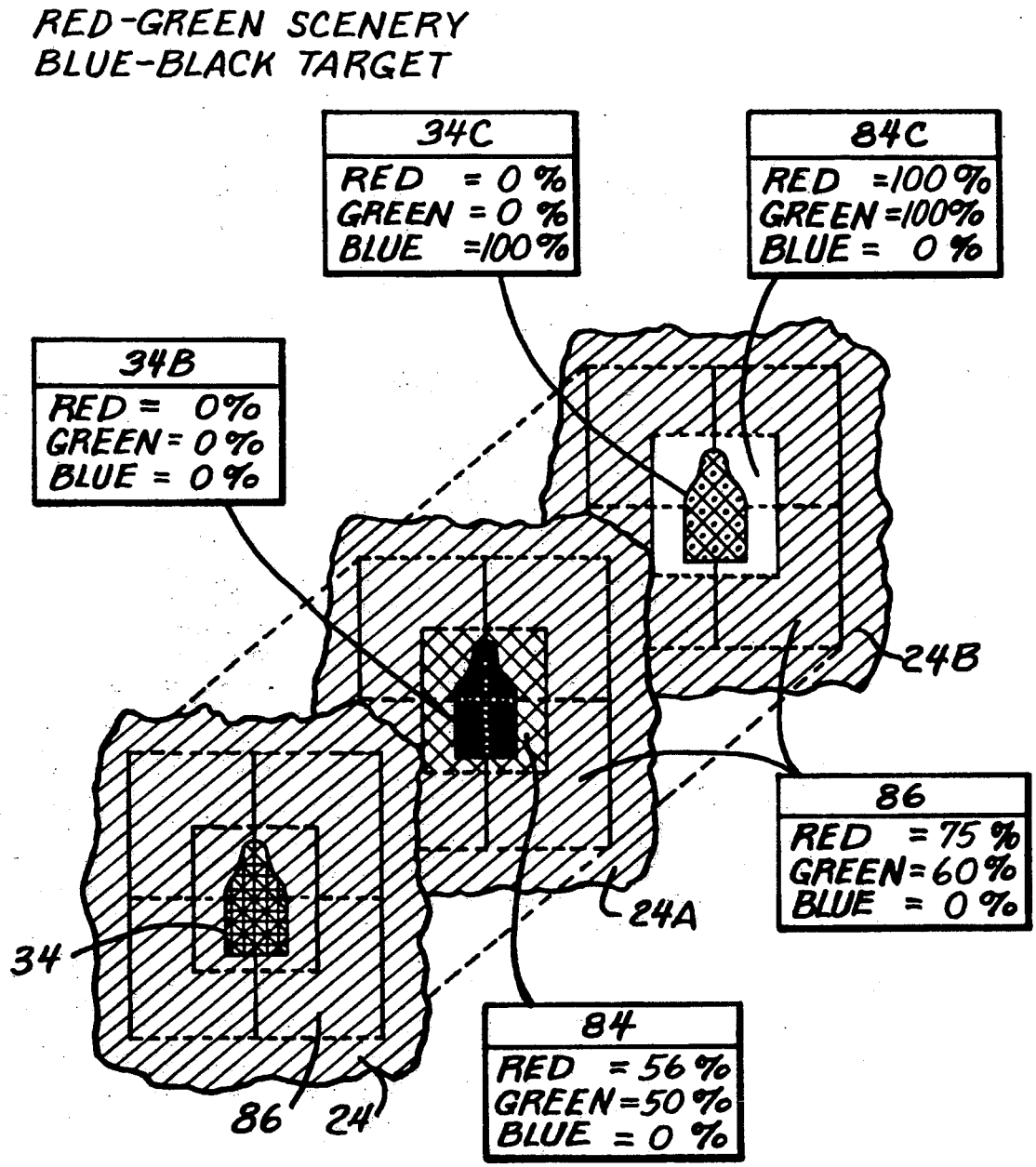

FIG. 4 through FIG. 4E pictorially show projector 22 displaying a target image scene 24 with target silhouette 34 as it is perceived by a human observer. The perceived scene is actually composed of two sequentially projected field images rapidly and repeatedly being projected. Field 24A and 24B, each has identical scenes with hue, contrast, and brightness, except for special target area 84B of projected field 24A and special target area 84C of projected field 84B.

If the average scene brightness for a black and white presentation, in the general area surrounding special area 84 of perceived target image scene 24 is approximately 75% of maxiumum system image brightness, except for the darker silhouette, the individual special area 84B of image "field" 24A would be at 50% brightness, except for the silhouette 34B being at zero percent brightness. The individual special area 84C of image field 24B would be at 100% of brightness except for target silhouette 34C being at 50% brightness. Since these two fields 24A and 24B are sequentially presented at a rate above the visual detection ability of a human observer, the perceived projected image 24 imperceptably includes special area 84 which blends into the surrounding scene 24 with just target silhouette 34 as the visible point-of-aim. It is a feature of the invention that the percentage of modulation of a special target area can be preset to any desired value from 5% to 100% of scene relative brightness whether such scene areas are monochrome or in full color.

In the initial development of the various monochromatic and multi-chromatic, special modulated areas 84, FIG. 4, 4A, for these examples, show the various percentage of brightness of the three color (RGB) beams utilized by the computer. In this computer system, an Amega 3000 computer system was utilized, wherein the system was capable of 4096 different hues of color—all controllable in percent of relative brightness and reproducable by the RGB projection means.

FIG. 4A is representative of a black and white monochrome target area scene where the color "white" requires all three basic colors, red, green and blue projector guns to be on and at equal brightness to generate "white", while all three color guns must be off to effect a "black".

FIG. 4B is representative of another monochrome color scheme wherein a single primary green color is used. In FIG. 4B the chromatic modulator, which is the spectral modulation, is in the visual green spectrum Special area 84 is modulated between 100% brightness outside of the target area 34, to 56% of that brightness. The target area 34 is brightness modulated from 56% to 0%.

The sensor means, if operating as a broad band sensor, is not color sensitive, and will see a net modulation of approximately 50% in brightness change from field to field of special area 84.

FIG. 4C is essentially as described in the prior discussion. The special modulated area 84 utilizes two primary colors to achieve the required area modulation.

FIG. 4D shows the special modulated area 84, containing target silhouette 34, comprised of the three basic RGB colors, red, green and blue, all blended in such a manner as to present a unique modulation of brightness to the sensor means while concurrently presenting a human observer a target scene 84 that blends into the foreground/background area 24, as to be indistinguishable.

FIG. 4E is as described for FIG. 4D, wherein there are utilized the three color capabilities of the system.

Figure 6A:
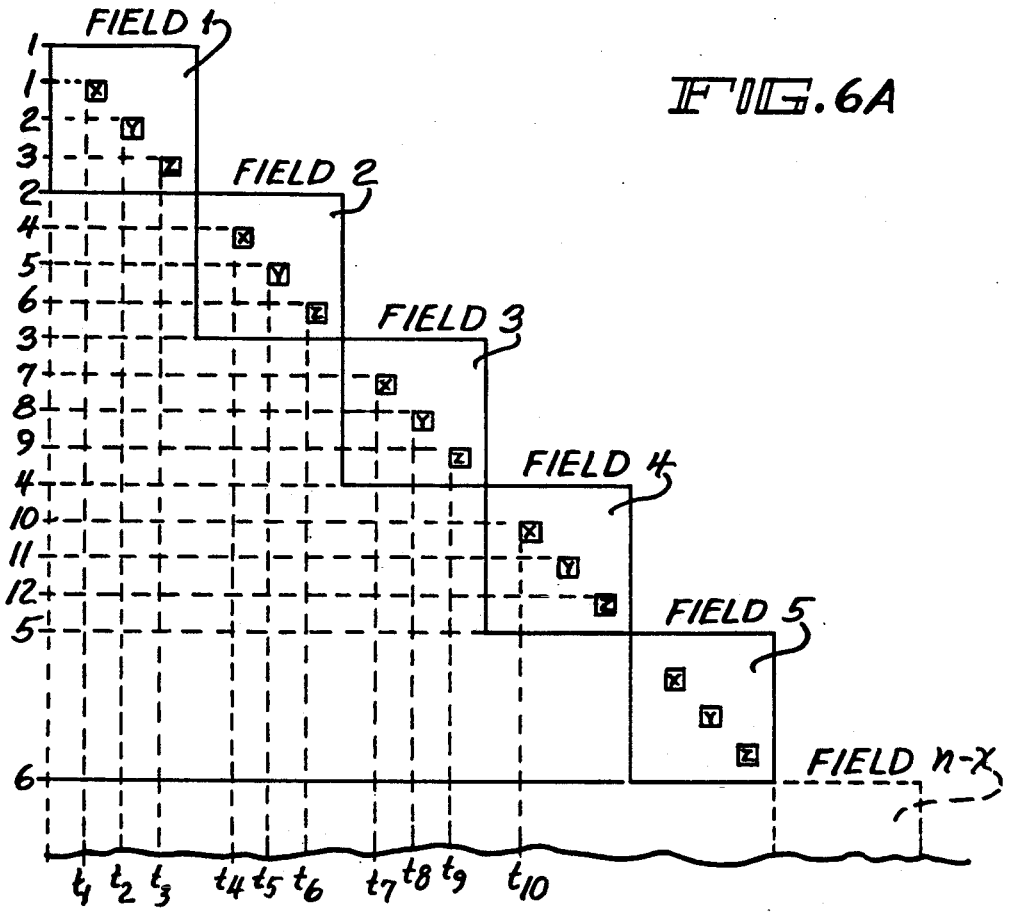
FIG. 6A and 6B show a spatial-phase-time relation between target image scene and the target point-of-aim engagement.
Figure 6B:
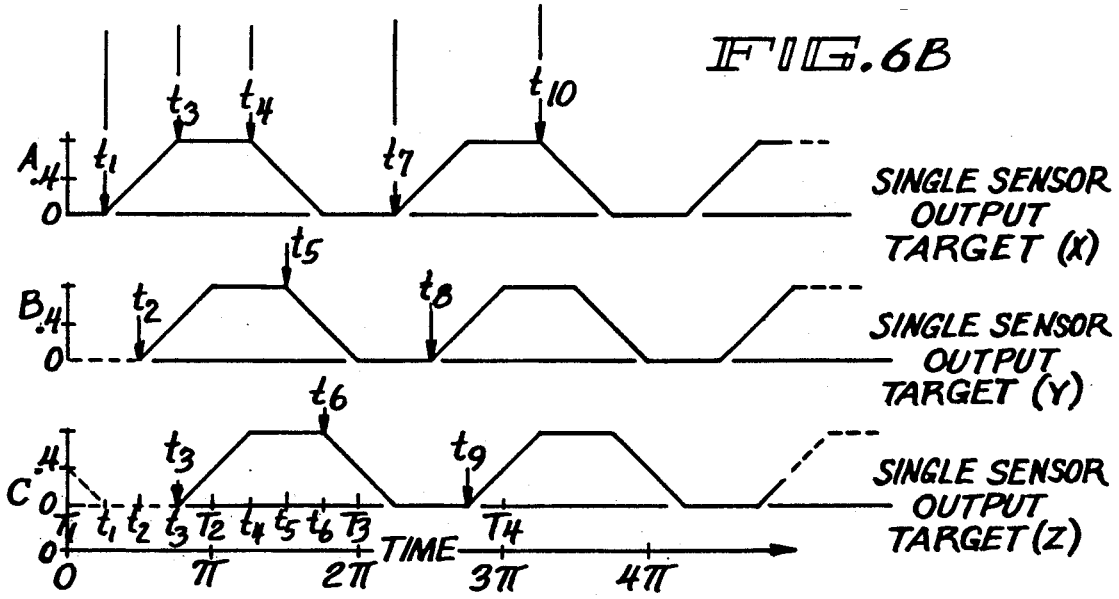

FIG. 6A and FIG. 6B illustrate the relative phase differences in the cyclical aim sensor output data from each of the three trainees' aim sensors in FIG. 1 depending on the spatial location of each target silhouette's special brightness modulated area in relation to the total scene area. The target image scene 24 of FIG. 1 is shown as a video projected composite scene including three target silhouettes 34, 88 and 90. In FIG. 6, each of these three targets is assumed to be stationary and the visual image frame 24 is composed of layering two field scenes per frame to generate special brightness modulated areas, one each associated with each of the target silhouettes.

FIG. 6A shows three special target areas of each scene field designated as X, Y and Z for the field (1) and X, Y and Z for field (2). In field (2), special target areas X, Y and Z are 50% darker than the field (1) special target areas. Thus, as the even field number special areas are 50% darker than the odd field number special areas and if these fields are sequentially presented at a continuous rate of sixty fields per second, the aim sensor, upon acquiring these special modulated areas, will generate cyclical output data, whose amplitude and phase relationship to the total scene area time frame of display are depicted in FIG. 6B which shows sensor outputs A, B and C corresponding to sensors 32, 32A and 32B respectively.

In FIG. 6A, time starts at $T_1$ of field 1 and the computer video output paints a horizontal image line from left to right and subsequent horizontal image lines are painted sequentially below this until a full image field is completed and projected at time $T_2$. Time $T_2$ is also the start of the next field image scene to be projected and painted as horizontal image line 1 of field (2), $T_3$ horizontal image line 1 of field (3), $T_4$ horizontal image line 1 of field (4), et seq.

The start of these special brightness modulated image areas is shown as starting at time $t_1$, $t_2$, and $t_3$ of image field (1) $t_4$, $t_5$, $t_6$, of image field (2), $t_7$, $t_8$, $t_9$ of image field (3), and as time sequentially shown.

From observation of FIG. 6B, the sensors output voltage phase relationship to a point of time reference $T_1$, $T_3$, $T_5$, et seq. it is apparent that each unique area generates a cyclical output voltage whose phase is related to the time domain of each image "frame" start time, $T_1$, $T_3$, $T_5$ . . . et seq.

Referring again to FIG. 4, the video projector 22 is shown displaying a target image scene 24 with a single target silhouette 34 as perceived by a human observer whereas, in actuality, the image scene 24 is composed of two separate image fields 24A and 24B.

The prior discussion of FIG. 4 dealt in the realm of special brightness modulated areas 84B and 84C effecting a cyclical amplitude modulated output from sensor means 32 of FIG. 1. Such modulation of the special area 84 of FIG. 4 can also be advantageously accomplished by effecting a spectral modulation of the special area 84 of FIG. 4 by inserting a spectral selective filter into the optical path of the aim sensor and utilizing the full color capabilities of the video diplay system to implement the spectral modulation as shown in FIG. 7.

Figure 7:
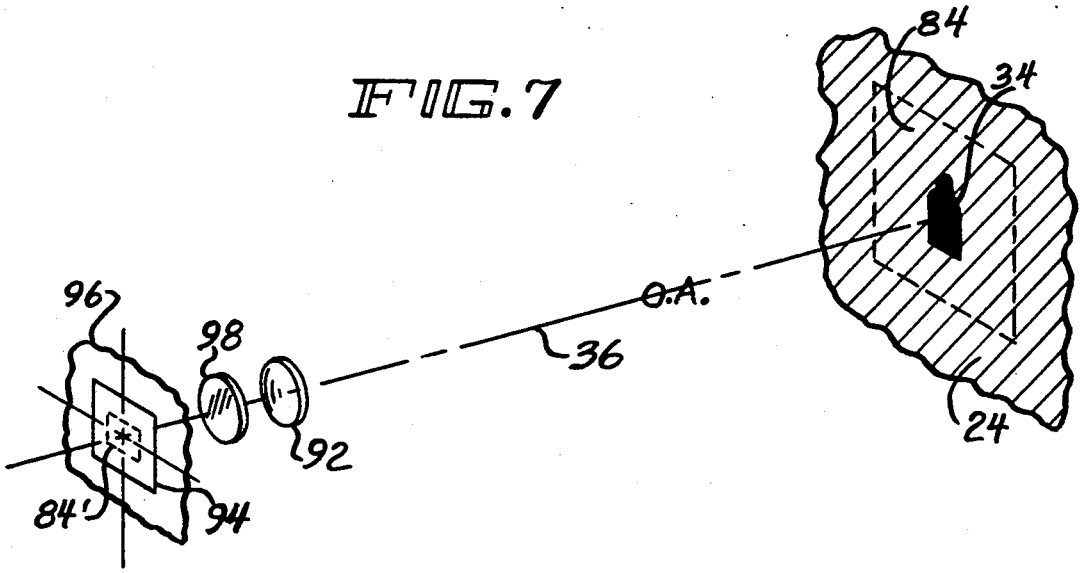
FIG. 7 is an optical schematic diagram of a preferred embodiment of the point-of-aim sensor employing selective spectral filtering means.

FIG. 7, for drawing simplicity, shows just the optical components of the point-of-aim sensor 32. Objective lens 92 images special multicolored area 84 with its target silhouette 34 as 84' onto the broad-spectral sensitivity quad detector array 94 in the back focal plane 96 of lens 92. Inserted between this broad band quad sensor and objective lens is special spectral selective filter 98. Filter 98 can have whatever spectral band-pass or band rejection characteristic as desired to selectively match one or more of the primary colors used in generating the composite multi-color imagery as composed on separate fields 24A through 24B in FIG. 4 through FIG. 4E. Such blending of separate primary colors in separate field images will be perceived by the trainee as a matching hue of the imagery of the areas in and around special modulation area 84. The aim sensor contrastingly having these spectrally different color fields sequentially presented to it, and its optics having a special matched spectral rejection filter in its wide band sensor's optical path, will have little or no brightness associated with that particular sequentially presented image field and thus will generate a cyclical output data whose amplitude is modulated and whose rate, or frequency is a function of field presentation rate and the number of fields per frame per second. Thus, sensor output data is developed identical to the previously discussed method.

Figure 8:
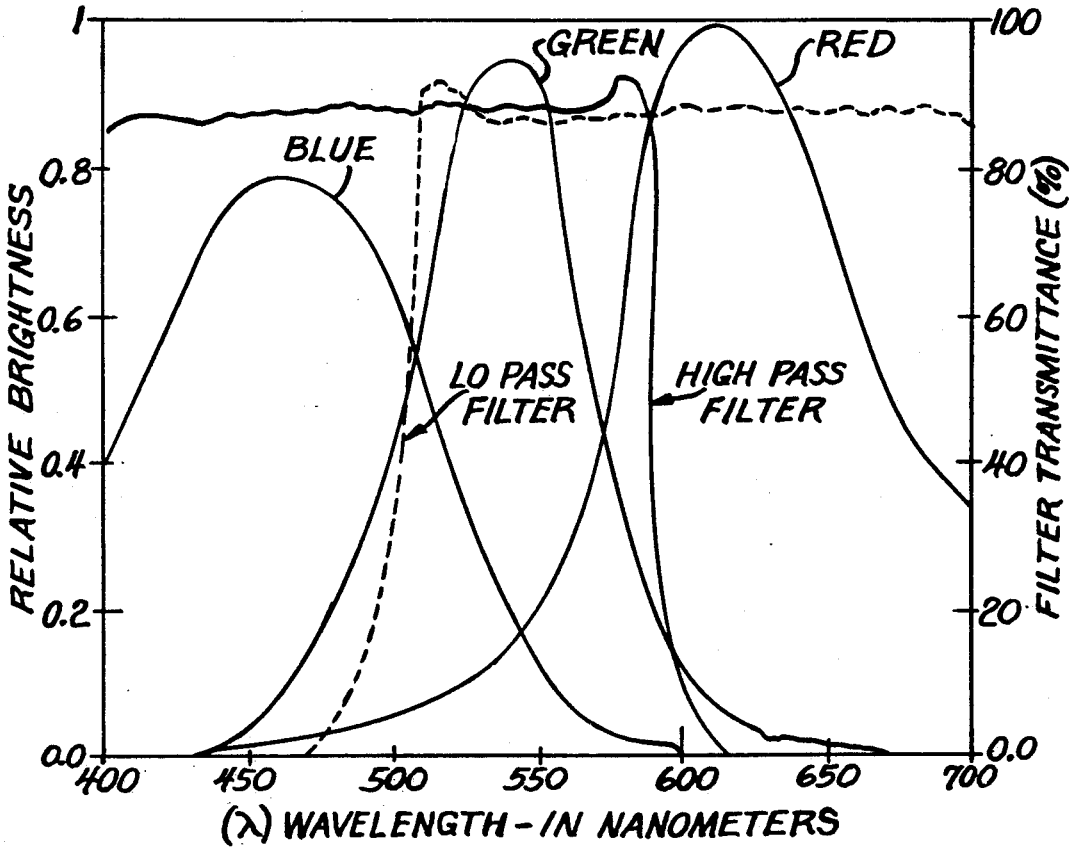
FIG. 8 illustrates the relative spectral characteristic of a typical R.G.B. projection system and of spectral selective filters adapted to sensor systems employed therewith.

FIG. 8 shows the relative spectral content of the RGB video projected image for the implementation of spectral brightness modulation areas as discussed in the inventive system of FIG. 7. Further, the filter means 98 of FIG. 7 can have the characteristics of either the low-pass or the high-pass filter, as shown in FIG. 8, as well as a band pass type filter (not shown in FIG. 8).

Not shown in FIG. 8, for the sake of simplicity, is the band width sensitivity requirements of sensor means (94) FIG. 7. Ideally, for the RGB primary colors, the sensor (94) should have uniform sensitivity over the visible band width of 400 nanometers to 700 nanometers. Also the sensor means (94) has uniform electromagnetic energy sensitivity throughout a spectral band width of 200 to 2000 nanometers (not shown). Further, the sensor means itself could be spectrally selective and therefore, preclude the need for inserted spectral filters.

In addition to the various methods of special area modulation described in this disclosure, other methods of special area modulation will become apparent to those skilled in the arts; one such method being brightness modulation based upon the polarization characteristics of light.

From the foregoing description, it can be seen that the invention is well adapted to attain each of the objects set forth together with other advantages which are inherent in the described apparatus. Further, it should be understood that certain features and subcombinations thereto are useful and may be employed without reference to other features and subcombinations. In particular, it should be understood that in several of the described embodiments of the invention, there has been described a particular method and means for providing a target display which contains invisible to the eye high contrast areas surrounding targets and means for identifying designated targets. Even though thus described, it should be apparent that other means for invisibly highlighting targets in either high or low contrast target scenes and utilizing video display projectors and their video drivers for effecting this result, could be substituted for those described to effect similar results. The detailed description of the invention herein has been with respect to preferred embodiments thereof. However, it will be understood that variations and modifications can be effected within the spirit and scope of the invention as described hereinabove and as defined in the appended claims.

We claim:

1. A simulator system for training weapon operators in use of their weapons without the need for actual firing of the weapons comprising background display means for displaying upon a target screen a stored visual image target scene, generating means for generating upon said visual image target scene one or more visual targets, either stationary or moving, with controllable visual contrast between said one or more visual targets and said visual image target scene, said generating means further comprising means for displaying one or more non-visible modulated areas, one for each of said one or more visual targets, sensor means aimable at said target scene and at said one or more targets and sensitive to said one or more non-visible modulated areas and operable to generate output signals indicative of the location of one of said one or more non-visible modulated areas with respect to said sensor means, computing means connected to said background display means to control said visual image target scene and said one or more targets generated thereon so as to provide said controllable contrast therebetween, and said computing means connected to said sensor means effective to utilize said sensor means output signals to compute the location of the image of said one of said one or more visual targets with respect to said sensor means.

2. A simulator system as claimed in claim 1 wherein said computing means comprises spectrally selective brightness modulation means for controlling cyclical changes in relative brightness among said one or more visual targets.

3. A simulator system as claimed in claim 2 wherein said cyclical changes in relative brightness are generated at a predetermined data frequency rate.

4. A simulator system as claimed in claim 1 wherein said computing means comprises brightness modulation means to control cyclical changes in relative brightness at a temporal rate so as to be non-discernible to a human observer.

5. A simulator system as claimed in claim 4 wherein said cyclical changes in relative brightness are generated at a predetermined data frequency rate.

6. A simulator system as claimed in claim 1 wherein said sensor means output signals functionally comprise a preselected number of sensor elements, each of said sensor elements having a field of view, and each said field of view including a percentage of brightness of said location of the image of said one of said one or more non-visible modulated areas with respect to said sensor means.

7. A simulator system as claimed in claim 6 wherein said percentage of brightness modulation is presettable from 1% to 100% of said field of view relative brightness.

8. A simulator system as claimed in claim 1 wherein said sensor means output signals functionally comprise a preselected number of sensor elements, each of said sensor elements having a field of view, and each of said field of view including a percentage of spectral modulation of said location of the image of said one of said one or more non-visible modulated areas with respect to said sensor means.

9. A simulator system as claimed in claim 8 wherein said percentage of spectral modulation is presettable from 5% to 100% of said field of view relative brightness.

10. A simulator system as claimed in claim 1 wherein said sensor means aimable at said visual image target scene has uniform electromagnetic energy sensitivity throughout a spectral band width of 200 to 2000 nanometers.

11. A simulator system as claimed in claim 1 wherein said visual image target scene and said one of said one or more visual targets comprise at least two composite layered image field scenes per frame so as to generate on said visual image target scene specific areas of brightness modulation.

12. A simulator system as claimed in claim 1 wherein said visual image target scene and said one of said one or more visual targets contain one of said non-visible modulated areas associated with one of each of said visible targets to generate electrical data whose waveform cyclically varies in time from field to field at a predetermined rate undetectable by human vision capabilities.

13. A simulator system as claimed in claim 12 wherein said waveform's amplitude indicates an order of magnitude that is relative to the difference in relative brightness of said field to field presentation of said non-visible areas, and said waveform further indicating a specific phase relationship relative to the starting time of rastering out of each image field and to the spatial position of each specific target image in said field engaged by said sensor means.

14. A simulator system as claimed in claim 1 wherein said sensor means is spectrally selective discriminatory of said visual image target scene within said target means and has a specific area chromatically modulated at a preselected frequency so as to ensure high signal to noise ratio of said sensor's output signals independent of a visually perceived chromatic image.

15. A simulator system as claimed in claim 14 wherein said visual image target scene is monochromatic.

16. A simulator system as claimed in claim 14 wherein said visual image target scene is fully chromatic.

17. A simulator system as claimed in claim 1 wherein said computing means provides a mixture of discrete and separate visual image target scenes selectively displayed from live video imagery, pre-recorded real like imagery and computer generated graphic imagery in monochromatic and fully color chromatic hues, said mixture of discrete and separate scenes including said one or more visual targets selectively controlled to present to a weapon operator a real life target related to environment and various times a day, and said computing means provides to said sensor means said non-visible modulated areas and change said to the in the form of said subliminal target identification area patterns of high contrast ratio related to background and foreground target brightness independent of said weapon operator perceived brightness and contrast of said visual target scenes.

18. A simulator system for training weapon operators in use of their weapons without the need for actual firing of a weapon, comprising, display means for displaying a plurality of stored background visual image target scenes, generating means for presenting upon said target scenes one or more visual image targets, either stationary or moving, with controllable visual contrast between said target scenes and said one or more visual image targets, said generating means further comprising means for simultaneously generating one or more non-visible patterns forming subliminal target identification area patterns, one for each of said visual image targets and each disposed and configured relative to its associated visual image target so as to enable computation of a weapon point of aim with respect to said one of said visual image targets, sensor means aimable at said visual image targets, and sensitive to said subliminal target identification area patterns to generate output signals indicative of the location of said subliminal target identification area patterns with respect to said sensor means, and computing means connected to said display means to control the generated target scenes, the visual image targets and the subliminal target identification area patterns generated thereon including said controllable visual therebetween to utilize said sensor output signals so as to compute the location of said visual image targets with respect to said sensor means.

19. A simulator system as claimed in claim 18 wherein said computing means comprises spectrally selective brightness modulation means for controlling cyclical changes in relative brightness among said one or more said image targets.

20. A simulator system as claimed in claim 19 wherein said modulation means interrupts said cyclical changes in relative brightness at a temporal rate so as to be non-discernible to a human observer.

21. A simulator system as claimed in claim 20 wherein said cyclical changes in brightness are generated at a predetermined data frequency rate.

22. A simulator system as claimed in claim 18 wherein said sensor means output signals functionally comprise a preselected number of sensor elements, each of said sensor elements having a field of view, and each said field of view including a percentage of brightness of said location of said one of said one or more visual image targets and said one of said one or more subliminal target identification area patterns with respect to said sensor means.

23. A simulator system as claimed in claim 18 wherein said sensor means output signals functionally comprise a preselected number of sensor elements, each of said sensor elements having a field of view, and each of said field of view including a percentage of spectral modulation of said location of said one of said one or more visual image targets and said one of said one or more subliminal target identification area patterns with respect to said sensor means.

24. A simulator system as claimed in claim 23 wherein said percentage of spectral modulator is presettable from 5% to 100% of said field of view relative brightness.

25. A simulator system as claimed in claim 22 wherein said percentage of brightness is presettable from 1% to 100% of said field of view relative brightness.

26. A simulator system as claimed in claim 18 wherein said sensor means aimable at said visual image target scene has uniform electromagnetic energy sensitivity throughout a spectral band width of 200 to 2000 nanometers.

27. A simulator system as claimed in claim 18 wherein said visual image target scene and said one of said one or more visual targets comprise at least two composite layered image field scenes per frame so as to generate on said visual image target scene specific areas of brightness modulation.

28. A simulator system as claimed in claim 18 wherein said visual image target scene and said one of said one or more visual targets contain one of said non-visible modulated areas associated with one of each of said visible targets to generate electrical data whose waveform cyclically varies in time from field to field at a predetermined rate undetectable by human vision capabilities.

29. A simulator system as claimed in claim 28 wherein said waveform's amplitude indicates an order of magnitude that is relative to the difference in relative brightness of said field to field presentation of said non-visible areas, and said waveform further indicating a specific phase relationship relative to the starting time of rastering out of each image field and to the spatial position of each specific target image in said field engaged by said sensor means.

30. A simulator system as claimed in claim 18 wherein said sensor means is spectrally selective discriminatory of said visual image target scene within said target scene and has a specific area chromatically modulated at a preselected frequency so as to ensure high signal to noise ratio of said sensor's output signals independent of a visually perceived chromatic image.

31. A simulator system as claimed in claim 30 wherein said visual image target scene is monochromatic.

32. A simulator system as claimed in claim 30 wherein said visual image target scene is fully chromatic.

33. A simulator system as claimed in claim 18 wherein said computing means provides a mixture of discrete and separate visual image target scenes selectively displayed from live video imagery, pre-recorded real like imagery and computer generated graphic imagery in monochromatic and fully color chromatic hues, said mixture of discrete and separate scenes including said one or more visual targets selectively controlled to present to a weapon operator a real life target related to environment and various times of day, and said computing means provides to said sensor means said non-visible patterns in the form of said subliminal target identification area patterns of high contrast ratio related to background and foreground target brightness independent of said weapon operator perceived brightness and contrast of said visual target scenes.

34. A method of generating target scenes for use in a weapon training simulator where the overall target scene is variable in contrast and contains one or more individual targets whose apparent contrast with respect to the target scene can be controlled and includes invisible target enhancement contrast; comprising the steps of providing a stored visual image target scene which is generated by background display means, generating at least one visual target for showing upon said visual image target scene, with controllable visual contrast between said at least one visual target and said visual image target scene, simultaneously generating for each said visual target a non-visible modulated area associated therewith, providing sensor means aimable at said visual target and sensitive to said non-visible modulated area, generating output signals from said sensor means to indicate location of said non-visible modulated area with respect to said sensor means, and processing data from said output signals from said sensor means for determining the location of said visual target with respect to said sensor means and for spectrally selective brightness among said at least one visual targets and said visual image target scene.

35. A simulator system for training weapon operators in use of their weapons without the need for actual firing of the weapons comprising background display means for displaying upon a target screen a stored visual image target scene, generating means for generating upon said visual image target scene one or more visual targets, either stationary or moving, with controllable visual contrast between said one or more visual targets and said visual image target scene, said generating means further generating one or more non-visible modulated areas, one for each of said one or more visual targets, said generating means presenting on said background display means a high density line image composite scene composed of a plurality of alternate odd and even horizontal lines, in an interlaced manner, said alternate odd and even lines having highly concentrated specific areas of brightness contrast different to each other, to said visual target scene and said line image composite scene, said generating means further presenting said line image composite scene by separating the odd line horizontal image and the even line horizontal image into two separate field images, so as to be displayed sequentially to generate a specific modulated area, one for each of said one or more visual targets, sensor means aimable at said target scene and at said one or more targets and sensitive to said one or more non-visible modulated areas and operable to generate output signals indicative of the location of one of said one or more non-visible modulated areas with respect to said sensor means, computing means connected to said background display means to control said visual image target scene and said one of more targets generated thereon so as to provide said controllable contrast therebetween, and said computing means connected to said sensor means effective to utilize said sensor means output signals to compute the location of the image of said one of said one or more visual targets with respect to said sensor means.

36. A simulator system as claimed in claim 35 wherein said generating means is operable to control said specific modulated area for each of said visual targets at a predetermined percentage of brightness modulation so as to obtain a desired value of monochromatic and fully chromatic hue.

* * * * *